US005450735A

United States Patent [19]

Esaki et al.

[11] Patent Number: 5,450,735

[45] Date of Patent: Sep. 19, 1995

[54] DOOR LOCKING HANDLE ASSEMBLY OF PULL-OUT AND SIDE-SWINGING LEVER-ACTION TYPE

[75] Inventors: Takanobu Esaki; Kenichi Yamada, both of Tokyo, Japan

[73] Assignee: Takigen Manufacturing Co. Ltd., Tokyo, Japan

[21] Appl. No.: 197,067

[22] Filed: Feb. 16, 1994

[30] Foreign Application Priority Data

Apr. 7, 1993 [JP] Japan ..... 5-105075

[51] Int. Cl.[6] ..... E05B 13/10; E05C 3/08

[52] U.S. Cl. ..... 70/208; 74/527; 74/528; 74/531; 292/204; 292/207; 292/336.3; 292/DIG. 31

[58] Field of Search ..... 70/208; 292/336.3, 207, 292/204, DIG. 31; 74/527, 528, 531

[56] References Cited

U.S. PATENT DOCUMENTS

| | | | |
|---|---|---|---|
| 2,208,818 | 7/1940 | Schaffler | 292/DIG. 31 X |
| 2,573,028 | 10/1951 | Kramer | 292/336.3 |
| 4,370,874 | 2/1983 | Munn | 70/204 |

FOREIGN PATENT DOCUMENTS

| | | | |
|---|---|---|---|
| 1237504 | 4/1960 | France | 292/336.3 |
| 198764 | 12/1988 | Japan . | |
| 208864 | 1/1924 | United Kingdom | 292/204 |
| 895481 | 5/1962 | United Kingdom | 292/336.3 |
| 2258008 | 1/1993 | United Kingdom | 292/204 |

*Primary Examiner*—Lloyd A. Gall
*Attorney, Agent, or Firm*—Martin Smolowitz

[57] ABSTRACT

A door locking handle assembly of pull-out and side-swinging lever-action type, including a locking shaft 11, to which a catch plate 36 is fixed, is inserted in a cylindrical portion 2 of a casing 1, a retractable handle 19 received in the casing 1 is pivoted to the shaft 11 through a pivot 35, a spring-support plate 29 is axially slidably mounted on the shaft 11 but not rotatable relative to the shaft 11, a spring 37 urges the plate 29 toward a front-end of the shaft 11, wherein a cross-shaped click concave 23 is provided in a bearing surface 22 of the handle 19, and engaged with a corresponding cross-shaped click convex 31 provided in a bearing surface 30 on a front surface of the plate 29 when the handle 19 is projected from the casing 1 and side-swing, so that the handle 19 is held in a position in which a front end **36*a* of the plate 36 is retracted behind a rear surface 53*b* of the door 53.**

5 Claims, 7 Drawing Sheets

DOOR LOCKING HANDLE ASSEMBLY OF PULL-OUT AND SIDE-SWINGING LEVER-ACTION TYPE

BACKGROUND OF THE INVENTION

1. Field of the Invention

The present invention relates to a door locking handle assembly of a pull-out and side-swinging lever-action type. The door locking handle assembly is used in a plugboard box and the like. In operation, the retractable handle of the assembly is pulled out of its casing and side-swung through a predetermined angle to permit a catch plate of the assembly to be free from a receiving portion of a stationary frame element.

2. Description of the Prior Art

In a conventional door locking handle assembly of a pull-out and side swinging lever-action type disclosed in Japanese Utility Model Laid-Open No. Sho 63-198764: a cylinder portion is provided in a base-end portion of a casing fixedly mounted on a door; a locking shaft is rotatably mounted in the cylindrical portion in an insertion manner; a catch plate is fixedly mounted on a rear-end portion of the locking shaft; a retractable handle folds into a front concave portion of the casing, and has its base-end portion pivoted to a front-end portion of the locking shaft through a cross pivot; a biasing spring for swingably biasing the retractable handle in its projecting direction on the cross pivot, the biasing spring being mounted between the locking shaft and the handle; a locking aperture is provided in a finger-engaging projecting portion of a front-end portion's rear surface of the handle; a lock unit is fixedly embedded in a lock-receiving portion provided in a front-end portion of the casing; and, a latch element is so arranged as to be interlocked with a rotor of the lock unit, and is biased forward towards the finger-engaging projecting portion by a return spring to have a front-end portion of the latch element engaged with the locking aperture so that the handle is locked up in its retracted position.

However, in the conventional door locking handle assembly described above, when the handle is projected from the front concave portion of the casing so that the front-end portion of the catch plate is disengaged from the receiving portion of the stationary frame element so as to lave a front-end portion of the catch plate retracted behind a rear surface of the door, there is a fear that the handle is swung back by gravity to have the front-end portion of the catch plate projected from a side surface of the door, and the thus projected front-end portion of the catch plate hits the edge portion of the stationary frame element when the door is closed.

SUMMARY OF THE INVENTION

It is an object of the present invention to provide a door locking flush handle assembly of a pull-out and side-swinging lever-action type, in which assembly a handle can be held in a position in which a front-end portion of a catch plate is retracted behind a rear surface of a door.

The above objects of the present invention are accomplished by providing:

a door locking handle assembly of a pull-out and side-swinging lever action type, comprising:

a casing for fixedly mounting on a door;

a locking shaft which is rotatably mounted in a cylindrical portion of a base-end portion of the casing in an insertion manner, and is provided with a cross-pivot support axially extending, but non-axially slidable in the cylindrical portion, and has its rear-end portion fixed to a catch plate;

a retractable handle which is received in a front concave portion of the casing, and has its base-end portion pivoted to the cross-pivot support of the locking shaft through a first cross pivot;

a spring-support plate axially slidably mounted on the locking shaft, the spring-support plate being non-rotatable relative to the casing and the locking shaft; and a coil spring for urging the spring-support plate toward a front end of the locking shaft;

wherein a cross-shaped concave portion for producing a click sound is provided in a bearing surface of the base-end portion of the handle, and engaged with a corresponding cross-shaped convex portion for producing a click sound provided in a bearing surface of a front surface of the spring-support plate when the handle is projected from the front concave portion of the casing and side-swung, so that the handle is held in a position in which a front-end portion of the catch plate is retracted behind a rear surface of the door.

DESCRIPTION OF THE PREFERRED EMBODIMENTS

Figure 1:
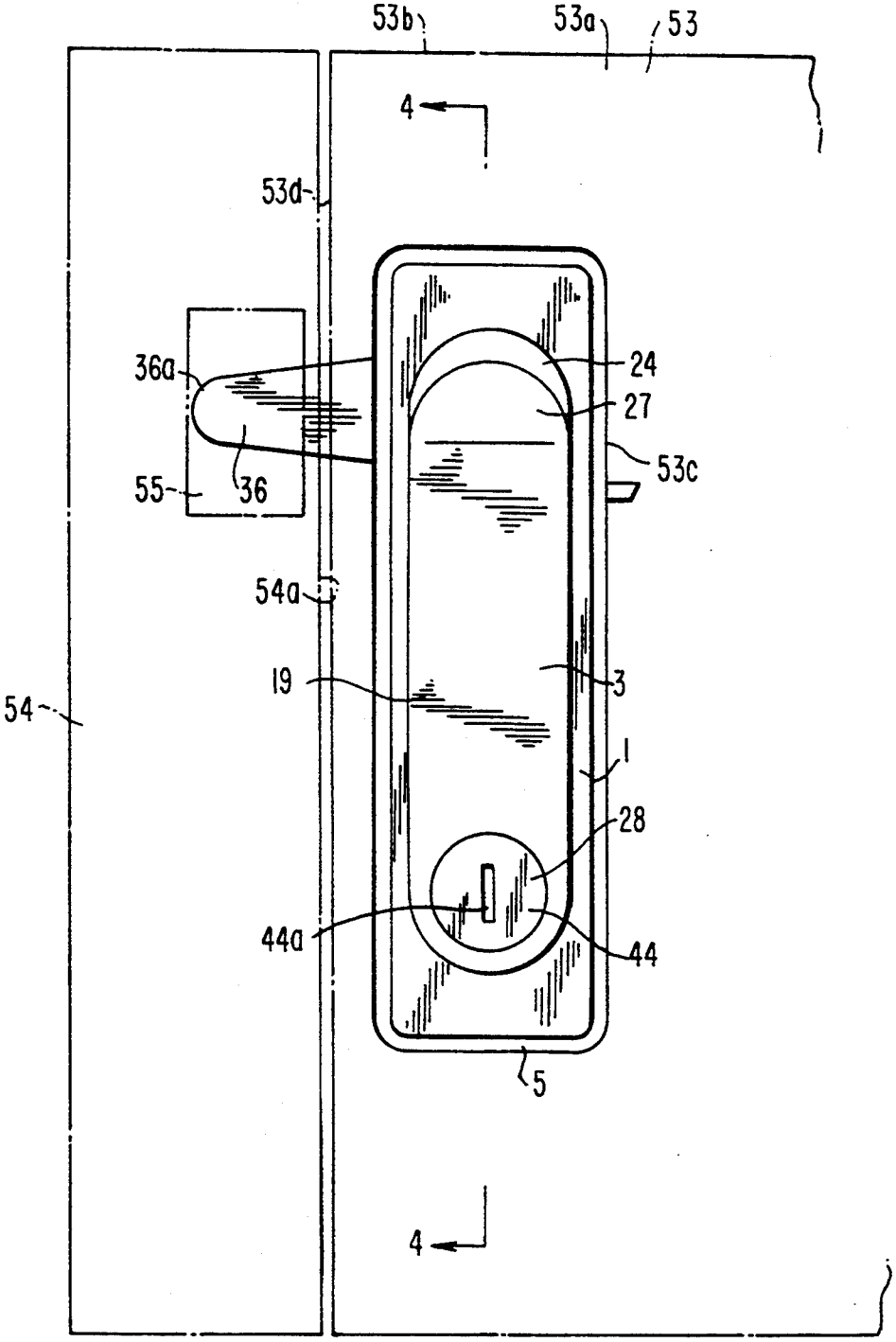
FIG. 1 is a front view of an embodiment of the door locking handle assembly of a pull-out and side-swinging lever-action type of the present invention.
Figure 2:
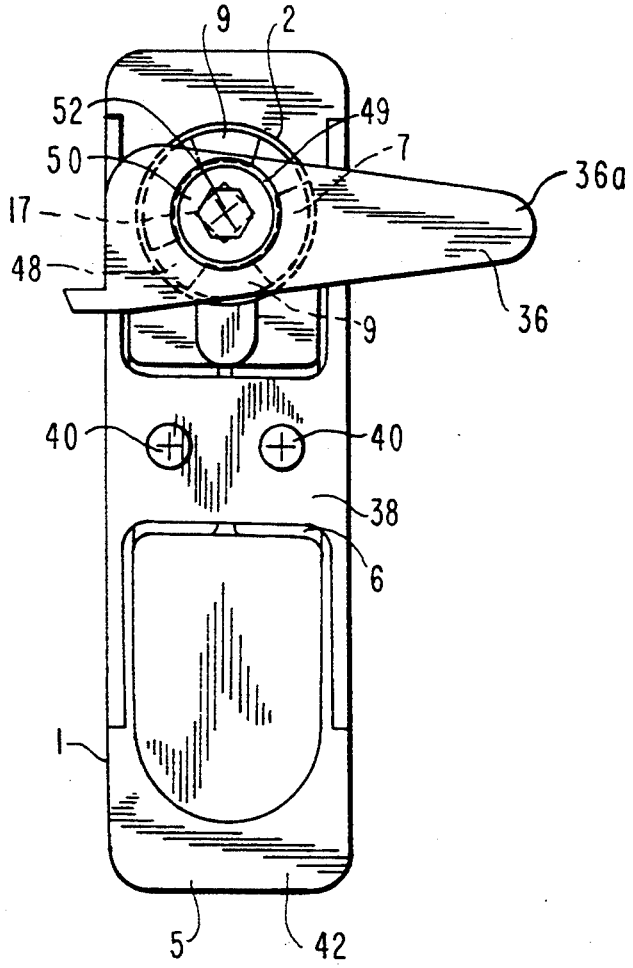
FIG. 2 is a rear view of the door locking assembly of the present invention shown in FIG. 1.
Figure 3:
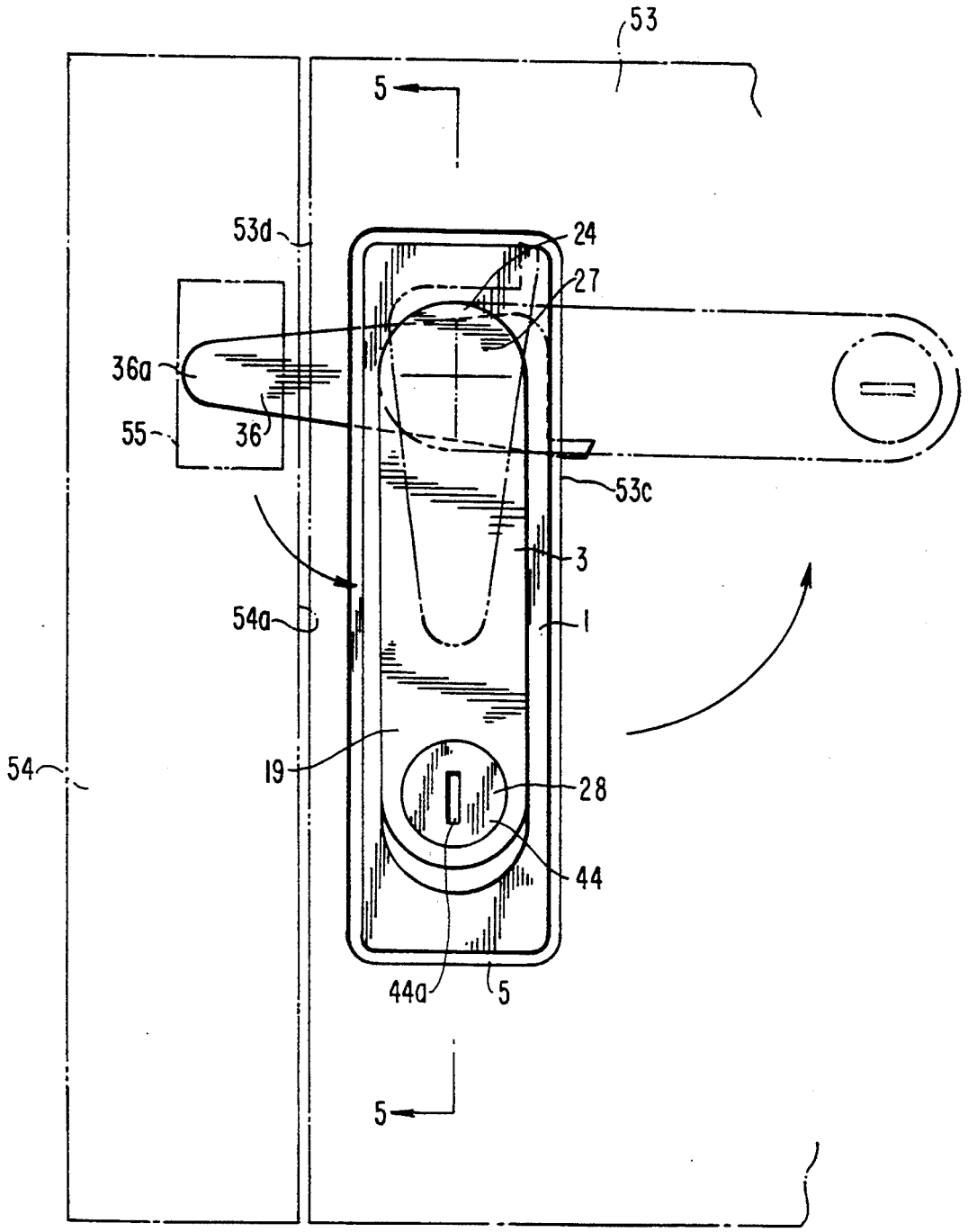
FIG. 3 is a front view of the door locking assembly of the present invention shown in FIG. 1, in a condition in which the handle is projected.
Figure 4:
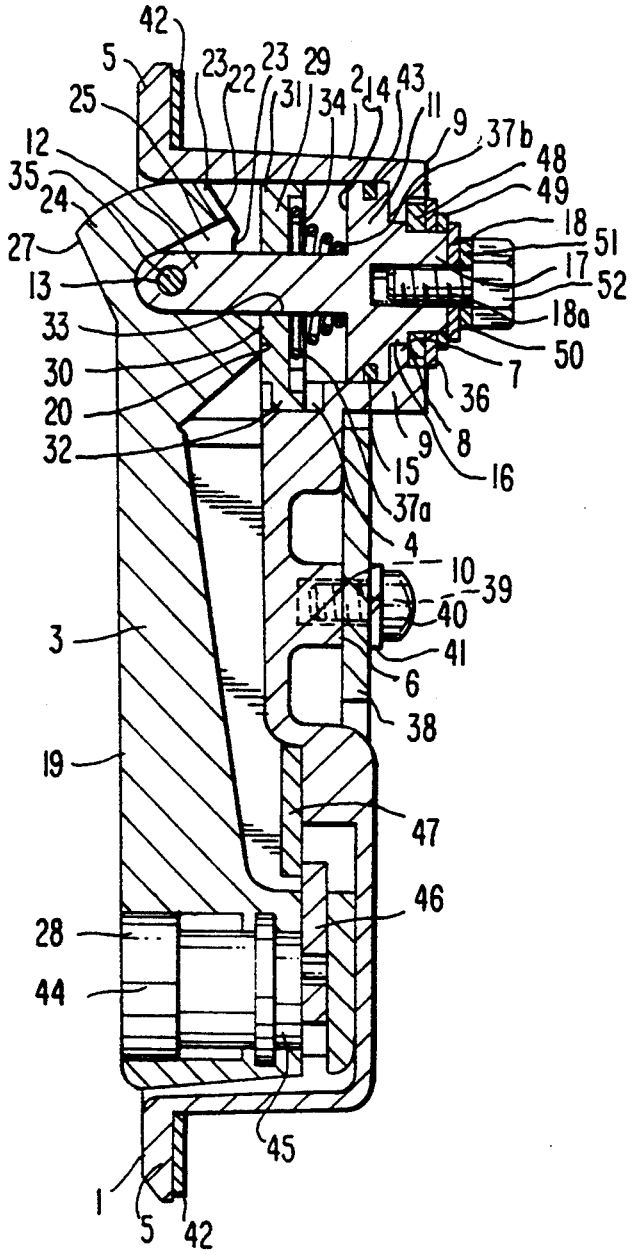
FIG. 4 is an enlarged sectional view of the door locking assembly of the present invention, taken along the line 4—4 of FIG. 1.

Hereinbelow, the present invention will be described in detail with reference to the accompanying drawings and the reference numerals and characters.

In a door locking handle assembly of a pull-out and side-swinging lever-action type according to the present invention, as shown in FIGS. 1–4, a casing 1 is fixedly mounted on a door 53, and provided with a cylindrical portion 2 in the casing base-end portion. Rotatably mounted in the cylindrical portion 2 in an insertion manner is a locking shaft 11 to a rear-end portion of which a catch plate 36 is fixedly mounted.

The locking shaft 11, which is provided with a cross-pivot support 12 axially extending, is not axially slidable in the cylindrical portion 2 of the casing 1. A retractable handle 19, which is received in a front concave portion 3 of the casing 1, has its base-end portion 24 pivoted to the cross-pivot support 12 of the locking shaft 11 through a cross pivot 35. On the other hand, a spring-support plate 29 is mounted on the locking shaft 11 so as to be axially slidable but not rotatable relative to the locking shaft 11. A coil spring 37 is so mounted as to urge the spring-support plate 29 toward a front end of the locking shaft 11.

A cross-shaped concave portion 23 for producing a click sound is provided in a bearing surface 22 of the base-end portion of the handle 19, and engaged with a corresponding cross-shaped convex portion 31 for producing a click sound provided in a bearing surface 30 on a front surface of the spring-support plate 29 when the handle 19 is projected from the front concave portion 3 of the casing 1 and side-swung, so that the handle 19 is held in a position in which a front-end portion 36*a* of the catch plate 36 is retracted behind a rear surface 53*b* of the door 53.

Figure 5:
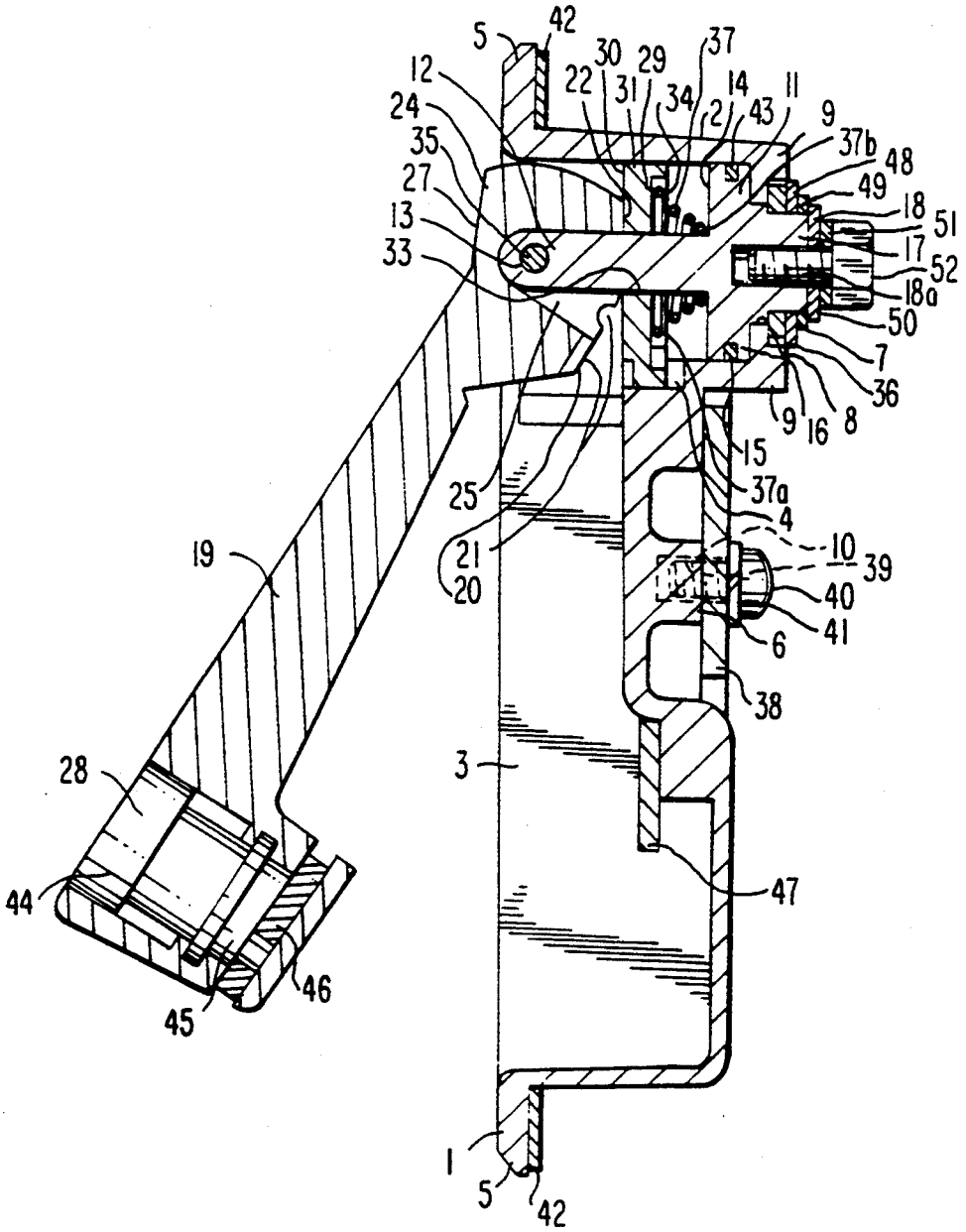
FIG. 5 is an enlarged sectional view of the door locking assembly of the present invention, taken along the line 5—5 of FIG. 3.

As shown in FIG. 5, when the handle 19 is projected from the front concave portion 3 of the casing 1, the cross-shaped concave portion 23 provided in the bearing surface 22 of the base-end portion of the handle 19 engages with the corresponding cross-shaped convex portion 31 provided in the bearing surface 30 on the front surface of the spring-support plate 29 to hold the handle 19 in its projecting position. When the handle 19 is rotated or side-swung, the spring-support plate 29 is slidably moved toward the rear end of the locking shaft 11 against a resilient force exerted by the coil spring 37, so that the concave portion 23 is disengaged from the convex portion 31. When the handle 19 is rotated through an angle of 90° to have a front-end portion 36*a* of the catch plate 36 disengaged from a receiving portion 55 of the stationary frame element 54 and the front-end portion 36*a* of the catch plate 35 is retracted behind a rear surface 53*b* of the door 53, the cross-shaped concave portion 23 engages again with the corresponding cross-shaped convex portion 31 to hold the handle 19 in its side-swung position.

Provided in a front-end portion of the spring supported plate 29 is a projection 32 which engages with a recess 4 of the casing 1, and is axially slidable but not rotatable relative to the locking shaft 11. Under the influence of the resilient force exerted by the coil spring 37 for urging the spring-support plate 29 toward the front end of the locking shaft 11, the cross-shaped concave portion 23 is disengaged from the corresponding cross-shaped convex portion 31 when the handle 19 is side-swung by the user. Even when the handle 19 is released in the thus side-swung position, the handle 19 is held against the gravity in such side-swung position under the influence of the resilient force exerted by the coil spring 37.

A first embodiment of the present invention is shown in FIGS. 1 to 8. As shown in FIG. 1, for the first embodiment of the present invention, the casing 1 is fixedly mounted in the door 53 as follows. Namely, first, the casing 1 is inserted into a longitudinal opening portion 53*c* of the door 53 from its front surface 53*a*, and has its outer peripheral flange portion 5 abutted against the front surface 53*a* of the door 53. Then, a U-shaped sheet metal bracket 38, which covers an intermediate portion of the casing 1 in its rear side, is abutted against a rear surface 53*b* of the door 53, and fixedly mounted on the door 53 through tapping screws 40, each of which passes through a through-hole 39 of the sheet metal bracket 38 and is threadably connected with a blind hole 10 formed in a rear wall 6 of the above intermediate portion of the casing 1. A packing 42 is interposed between the front surface 53*a* of the door 53 and the casing 1.

A watertight O-ring seal 43 is fitted in an annular groove 15 of the intermediate portion of the locking shaft 11. The cross-pivot support 12 of the locking shaft 11 assumes a circular-column form extending from a central portion of a front-end bearing surface 14 of the locking shaft 11. Further, the locking shaft 11 has its small-diameter portion 16 fitted in an axial hole 8 of a rear-surface wall portion 7 of the cylindrical portion 2 of the casing 1. The small-diameter portion 16 of the locking shaft 11 is followed by a square-column portion 17 on which both a swing-angle limiting plate 48 and the catch plate 35 are mounted in an insertion manner together with a spacer 49 and a flat washer 50, and then a bolt 52 is threadably connected with a threaded hole 18*a* provided in the rear-surface wall 18 of the locking shaft 11 to have these plates 48, 36 fixed to the square-column portion 17, so that the locking shaft 11 is rotatably mounted in the cylindrical portion 2 of the casing 1 but not axially slidable therein. A swing-angle limiting projection 9, which abuts against the swing-angle limiting plate 48 to cooperate therewith to limit the handle 19 in its swinging angle, is provided in the rear wall portion 7 of the cylindrical portion 2 of the casing 1 to limit the handle 19 in side-swinging angle.

The spring-support plate 29 assumes a disc-like form which is provided with a through-hole 33 in its central portion. The locking shaft 11 has its cross-pivot support 12 passed through the through-hole 33 of the spring-support plate 29. Provided in the front-end portion of the spring-support plate 29 is the projection 32 which engages with the recess 4 of the front-end portion of the cylindrical portion 2 of the casing 1, so that the spring-support plate 29 is mounted on the locking shaft 11 so as to be axially slidable but not rotatable on the locking shaft 11, and is not rotatable relative to the casing 1. The coil spring 37 has its opposite end portions 37*a* and 37*b* abut against: the bearing surface 34 of the rear surface of the spring-support plate 29; and the bearing surface 14 of the front-end portion of the locking shaft 11, respectively, so that the spring-support plate 29 is urged toward the front-end portion of the locking shaft 11. Provided in the front bearing surface 30 of the spring-support plate 29 is the cross-shaped convex portion 31 assuming a semicircular shape in cross section.

Figure 6:
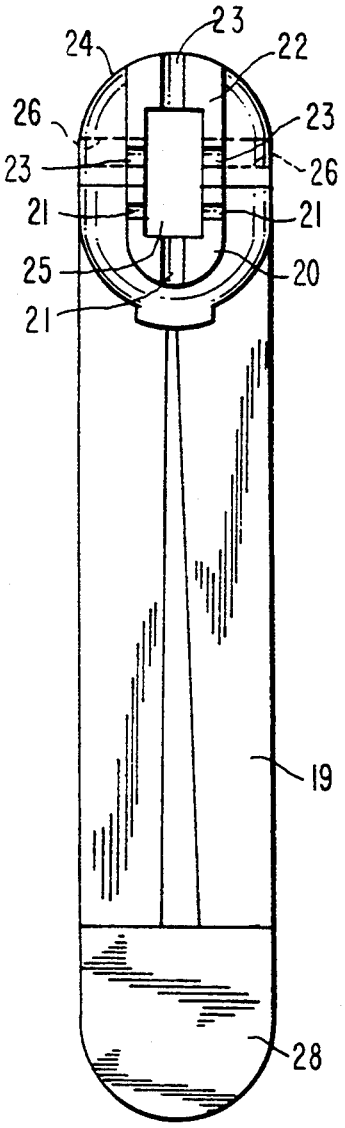
FIG. 6 is a rear view of the door locking assembly of the present invention shown in FIG. 1.
Figure 7:
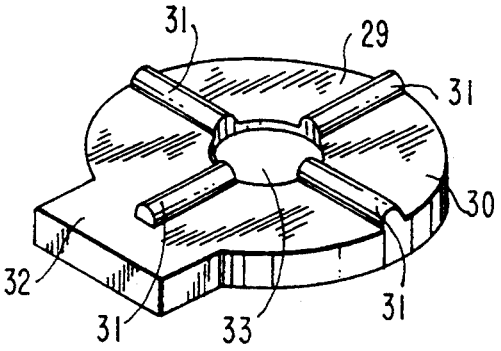
FIG. 7 is a perspective view of the spring-support plate of the door locking assembly of the present invention shown in FIG. 1.

As shown in FIG. 6, the base-end portion of the handle 19 is formed into a semispherical shape, and provided with: the bearing surface 20 abutting against the corresponding bearing surface 30 on the front surface of the spring-support plate 29 when the handle 19 is retracted; and the bearing surface 22 abutting against the corresponding bearing surface 30 of the spring-support plate 29 when the handle 19 is projected. These bearing surfaces 20 and 22 are provided with the cross-shaped concave portions 21 and 23, respectively. Each of the concave portions 21, 23 is selectively engaged with the corresponding convex portion 31 of the spring-support plate 29 in operation. Provided in the central portion of the base-end portion 24 of the handle 19 is a recess 25 in which the cross-pivot support 12 is received in an insertion manner. The cross pivot 35 passes through through-holes 26 provided in opposite side walls of the base-end portion 24 of the handle 19, and through a through-hole 13 provided in the front-end portion of the cross-pivot support 12, so that the handle 19 is pivoted to the locking shaft 11 through the cross pivot 35. Provided in the front surface of the base-end portion 24 of the handle 19 is an oblique finger-engaging portion 27 which is pushed by the user to swing the handle 19 on the cross pivot 35, so that the handle 19 is projected from the front concave portion 3 of the casing 1.

Provided in the front-end portion of the handle 19 is a lock-receiving portion 28 in which a lock unit 44 is fixedly mounted. After the front-end portion 36*a* of the catch plate 36 is engaged with the receiving portion 55 of the stationary frame element 54 and the handle 19 is retracted in the front concave portion 3 of the casing 1, a key is inserted in a keyhole 44*a* of the lock unit 44 to rotate a rotor 45 so that a front-end portion of a latch element 45, which is interlocked with the rotor 45 to move back and forth as the rotor 45 rotates, is engaged with a locking plate 47 fixed to the casing 1, whereby the door 53 is locked up relative to the stationary frame element 54 without fail. The lock-receiving portion 28 of the handle 19 also serves as a finger-engaging portion when the handle 19 is side-swung in operation.

As a means for locking up the handle 19 in its retracted position, it is also possible to use a lock unit fixed to the casing 1, and to provide a concave portion in the handle 19, engaged with the front end of the latch element 46 of the lock unit 44 so as to lock up the handle 19.

Figure 9:
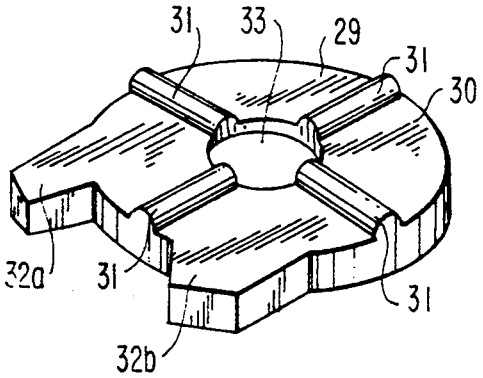
FIG. 9 is a perspective view of another embodiment of the spring-support plate shown in FIG. 7.
Figure 8:
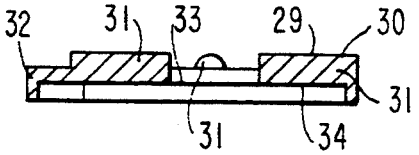
FIG. 8 is a sectional view of the spring-support plate shown in FIG. 7.
Figure 10:
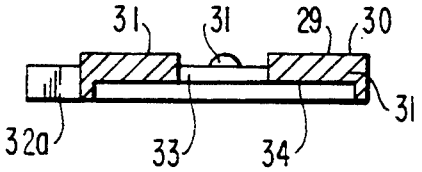
FIG. 10 is a sectional view of the spring-support plate shown in FIG. 9.

In addition to the above first embodiment of the present invention, the spring-support plate 29 can assume any other suitable shape such as ones shown in FIGS. 9 and 10 in which the spring-support plate 29 is provided with a pair of projections 32*a*, 32*b* in its front end.

As described above, in the door locking handle assembly of a pull-out and side-swinging lever action type according to the present invention: the cross-shaped concave portion 23 is provided in the bearing surface 22 of the base-end portion of the handle 19; the corresponding cross-shaped convex portion 31 is provided in the bearing surface 30 on the front surface of the spring-support plate 29; and, when the handle 19 is projected from the front concave portion 3 of the casing 1 and side-swung to have the front-end portion 36*a* of the catch plate 36 disengaged from the receiving portion 55 of the stationary frame element 54 so that catch plate 36 is retracted behind the rear surface 52*b* of the door 52, the convex portion 31 of the spring-support plate 29 is engaged with the concave portion 23 of the handle 19 to hold the handle 19 in its side-swung position. Consequently, there is no fear that the handle 19 swings back by gravity to have the front-end portion 36*a* of the catch plate 36 projected from the side surface 53*d* of the door and, therefore there is no fear that the front-end portion 36*a* of the catch plate 36 hits the edge portion 54*a* of the stationary frame element 54 when the door 52 is closed.

What is claimed is:

1. A door locking handle assembly of a pull-out and side-swinging lever-action type, comprising:

a casing (1) for fixedly mounting on a door (53);

a locking shaft (11) which is rotatably mounted in a cylindrical portion (2) of a base-end portion of said casing (1) in an insertion manner, and is provided with a cross-pivot support (12) axially extending, but is non-axially slidable in said cylindrical portion (2), and has its rear-end portion fixed to a catch plate (36);

a retractable handle (19) which is received in a front concave portion (3) of said casing (1), and has its base-end portion (24) pivoted to said cross-pivot support (12) of said locking shaft (11) through a first cross pivot (35);

a spring-support plate (29) axially slidably mounted on said locking shaft (11), said spring-support plate (29) being non-rotatable relative to said casing (1); and a coil spring (37) for urging said spring-support plate (29) toward a front end of said locking shaft (11);

wherein a cross-shaped concave portion (23) for producing a click sound is provided in a bearing surface (22) of said base-end portion of said handle (19), and engaged with a corresponding cross-shaped convex portion (31) for producing a click sound provided on a bearing surface (30) of said spring-support plate (29) when said handle (19) is projected from said front concave portion (3) of said casing (1) and side-swung, so that said handle (19) is held in a position in which a front-end portion (36*a*) of said catch plate (36) is retracted behind a rear surface (53*b*) of the door (53).

2. The door locking handle assembly of claim 1, wherein said casing (1) is fixedly mounted on the door (53) and said catch plate (36) is arranged to engage with a receiving portion (55) of a stationary frame (54).

3. The door locking handle assembly according to claim 1, wherein said casing (1) is inserted into an opening portion of the door (53), said casing having a peripheral flange (5) abutted against a front surface (53*a*) of the door (53) with a packing (42) interposed therebetween.

4. The door locking handle assembly according to claim 1, wherein said spring-support plate (29) has a pair of projections on its front end which prevent its rotating relative to casing (1).

5. The door locking handle assembly according to claim 1, wherein a lock unit (44) is mounted in a front-end portion of said handle (19), said lock unit (44) including a rotor (45) and a latch element (46) interlocked with the rotor and which can be engaged with a locking plate (47) fixed to said casing (1).

* * * * *